United States Patent [19]

Hayden

[11] 4,370,565

[45] * Jan. 25, 1983

[54] TIMED ELECTRIC SWITCH

[75] Inventor: Rodney Hayden, Stoney Creek, Canada

[73] Assignee: TRW Inc., Cleveland, Ohio

[ * ] Notice: The portion of the term of this patent subsequent to Jun. 30, 1998, has been disclaimed.

[21] Appl. No.: 200,856

[22] Filed: Oct. 27, 1980

Related U.S. Application Data

[62] Division of Ser. No. 967,923, Dec. 11, 1978, Pat. No. 4,276,483.

[30] Foreign Application Priority Data

Aug. 21, 1978 [CA] Canada ..... 301690

[51] Int. Cl.[3] ..... H01H 43/24

[52] U.S. Cl. ..... 307/141; 307/590; 335/186

[58] Field of Search ..... 335/164, 165, 186, 187; 361/195, 197, 198; 307/9, 10 R, 141, 141.4, 590

[56] References Cited

U.S. PATENT DOCUMENTS

| | | | |
|---|---|---|---|
| 2,898,433 | 8/1959 | Felt | 361/194 X |
| 3,303,396 | 2/1967 | Culbertson | 361/198 |
| 3,393,604 | 7/1968 | Lundin | 361/197 X |
| 3,842,375 | 10/1974 | Collette | 335/164 |
| 3,858,027 | 12/1974 | Phillips | 219/492 X |
| 3,898,423 | 8/1975 | Taylor et al. | 219/492 X |
| 3,939,361 | 2/1976 | Aidala et al. | 307/141 |
| 3,944,893 | 3/1976 | Hayden | 219/203 X |
| 3,973,140 | 8/1976 | Phillips | 307/293 X |
| 4,047,375 | 9/1977 | Wolff | 58/21.13 |
| 4,095,213 | 6/1978 | Hayden | 340/252 R |
| 4,101,001 | 7/1978 | Smith | 307/293 X |

*Primary Examiner*—G. Z. Rubinson
*Assistant Examiner*—James L. Dwyer
*Attorney, Agent, or Firm*—James R. O'Connor; Martin J. O'Donnell; Thomas C. O'Konski

[57] ABSTRACT

A timed switch for controlling an electric load has a relay mounted within the switch housing. The relay has a pair of contacts which are connected to the load, a movable core connected to one of the contacts and a holding coil which holds the core in and holds the contacts closed when energized and releases them when deenergized. The switch also has a timer; and a manual actuator for moving the core and closing the contacts, actuating the timer and actuating the relay coil. The timer is connected to the relay coil to deenergize the coil and release the contacts upon expiration of a predetermined interval measured by the timer. The contacts may also be opened by actuation of the manual actuator without having to overcome the holding force of the relay coil on the core.

5 Claims, 4 Drawing Figures

TIMED ELECTRIC SWITCH

This is a division of application Ser. No. 967,923, filed Dec. 11, 1978, now U.S. Pat. No. 4,276,483.

BACKGROUND OF THE INVENTION

This invention relates to a timed electric switch for supplying current to a load for periods of time which may be made to differ between a first and subsequent operations of the device.

The device finds particular application in the control of heavy direct current applied to window heaters in vehicles, particularly backlite heaters in automobiles and trucks where initial defrosting may require the application of current for an interval of the order of 10 to 15 minutes before switch-off. Subsequently the backlite heater may need to be reactivated for demisting purposes, however the subsequent periods may usefully be less than that of the first. With single period timers employed to date, the interval chosen has had to be a compromise.

It has become increasingly apparent over the last few years that sources of energy are not inexhaustible, that fuels for motor vehicles continue to increase in price, and that all possible savings in operation costs of the vehicle are to advantage. Further, backlite heaters intended for defrosting purposes draw heavy currents, in some instances, of the order of 40 amps, or even more where the trend is to larger glass areas, from a 12-volt car battery supply. At those times when headlights and in-car heaters are also switched on there is heavy competition for the available output from the battery and alternator. If the backlite has merely a simple on-off switch and the heater is used continuously in such conditions, particularly when the car is in stop-and-go traffic, the battery can be run flat.

I have disclosed a backlite timer in my prior Canadian Pat. No. 868,629 issued Apr. 13, 1971 directed to a long interval timing device to which reference may be made for background. The corresponding U.S. Pat. No. 3,571,665 issued Mar. 23, 1971.

That timer ensures that the heater is not on continuously by providing an interval of operation for defrosting and which can vary to some extent with environmental temperature conditions.

In this present disclosure, an electrical time switching device is described which allows not only an initial long period of operation but also provides the opportunity of having shorter periods of operation for the second and subsequent actuations of the device, such as is beneficial for demisting purposes after initial defrost action.

It is to advantage, and a device is so described, which includes an automatic reset after the automobile has been stopped, so that the next time the heater is required the backlite full initial timing period of operation can be provided. A typical period of operation would initially be 10 minutes with a 5-minute period in each subsequent operation. In some applications, second and subsequent periods of 2.5 minutes will be satisfactory.

To conform with the laws requiring continued improving gasoline consumption efficiency there is also a steady accent in the automobile manufacturing trade on the need to reduce weight. The device here disclosed can replace a switch, pilot-light, wiring harness, connectors, relay and timing circuitry currently employed in timed defrost arrangements, by a single package having typically one-third the weight of the assemblies now employed in the industry. Considerable cost savings per car can flow from lower initial cost and weight and space savings.

As will be further described herein with reference to specific embodiments of the invention, an energy efficient automatic simplified timing device can be constructed with manual actuation and override providing a positive "feel" to the operator and including a pilot-light indicator of essentially infinite life, all in a single package. Prototypes of specific embodiments here described have been delivering currents of 50 amperes both reliably and without any excessive contact heating.

SUMMARY OF THE INVENTION

In accordance with the invention there is provided, a timed switch for an electric load which comprises, a pair of contacts in series with said load, said load being actuated upon closing of said contacts, a timer circuit, means connecting said timer circuit for actuation upon closing of said contacts, a magnetic solenoid associated with said contacts actuable upon the closing of said contacts said contacts being held in closed condition thereby, means connecting said timer circuit for controlling current through said solenoid and for altering current flow through said solenoid after a chosen time period of operation of said timer circuit, said alteration of current through said solenoid effecting release of said contacts and interruption of current flow through said load, said timer circuit comprising an oscillator, and means sensitive to said oscillator for counting the output of said oscillator and for effecting said current alteration in said solenoid after a predetermined count has been detected by said oscillator sensitive means. Preferably current through the solenoid holds the contacts in closed condition with the timer circuit acting to interrupt current flow through the solenoid after the predetermined count has been reached. The oscillator sensitive means preferably comprises counter means and logic means for reading the counter and producing an output on reading a predetermined count and effecting interruption of current through the solenoid. The logic means may be effective upon production of a first output for switching to produce a subsequent output upon reading of a count different from the predetermined count. The logic may include a control electrode effective to set said logic for effecting output at said second count, wherein the second count is dependent upon the potential supply to the control electrode. The contacts may be manually closable and manually releasable, and re-setting of said logic may be effected by providing independent power supply means to the timer circuit separate from input to the timer circuit effected by closing of the contacts.

DESCRIPTION OF A PREFERRED EMBODIMENT

Figure 1:
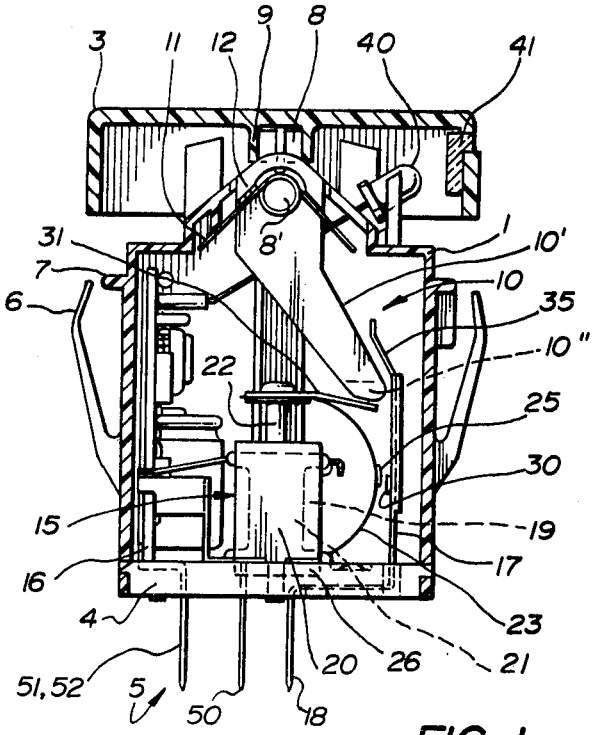
FIG. 1 is a side sectioned view of one embodiment of the complete timing switch package.
Figure 2:
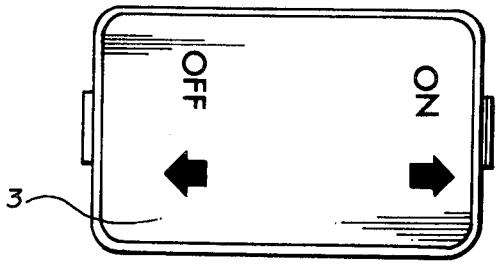
FIG. 2 is a plan view of the device from above.
Figure 3:
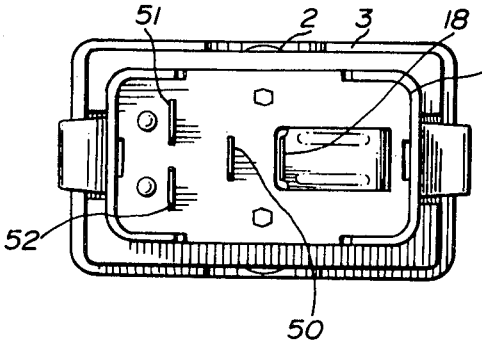
FIG. 3 is an under plan view of the device of FIG. 1.

With reference first to FIGS. 1 and 3, a casing 1 of a suitable plastic material, such as A.B.S., has pivoted to one end of it on projecting stubs 2 (FIG. 3), a manually rockable actuating cover 3. At the other end of the housing 1 extending from a mounting plate 4 are electrical contact spades 5 for connection to wiring harness or other socket terminals (not shown). Spring ears 6 on the case 1 in conjunction with stop flanges 7 enable the package assembly to be snap mounted, for instance in an automobile dashboard. Received in socket 9 of cover 3 is a stub 8 of an actuating arm 10. The arm 10 is pivoted on short shafts 8' coaxial with stubs 2 received in the housing 1, and is constructed as two downward depending sections 10' one behind the other in FIG. 1, straddled by a web 10". A spring 11 engages extensions on the arm 10 to effect a restoring action whenever the rockable cover 3 is displaced from the central position shown in FIG. 1. A second spring (not shown) behind spring 11 engages the arm 10 only when the cover 3 is rocked to displace the arm anti-clockwise, thereby providing a greater resilient resistance to the cover 3 when the arm is rotated anti-clockwise, from that encountered when it is rotated clockwise. This improves the balanced "feel" of the device as will be explained later.

Mounted on the plate 4 is a relay yoke, coil, and core assembly 15, a timing circuit board 16 and a spring metal, e.g., beryllium copper or phosphor bronze, output contact post 17 connected to output spade contact 18. Beryllium copper alloys are preferred for the post material.

The relay assembly comprises yoke 20 containing coil and former assembly 21, movable core 22 with an armature or "obturator" 23 made of a suitable conductive spring metal material such as beryllium copper or phosphor bronze. The obturator carries a contact 25. By virtue of the fact that the obturator 23 is fastened at its bottom end by retention between yoke 20 and a magnetically permeable end plate 26, downward movement of the core 22 causes contact 25 to move both in an outward and a downward direction and thus effects very efficient contact wiping action with the contact 30 mounted on post 17. The particular way in which this kind of wiping action and relay obturator structure produces very efficient contacting is described in my U.S. Pat. Nos. 4,003,011 issued Jan. 11, 1977 and 4,064,470, issued Dec. 20, 1977. Further details of this particular structure will not be elaborated here.

A shoulder flange 31 extends from the upper end of core 22 where it is engageable by the web 10". Rocking of the arm 10 in the clockwise direction shown in FIG. 1 causes the web to depress shoulder 31 pushing the core 22 into the coil former 21 and causing contact 25 to engage contact 30. When the core 22 is depressed fully into the former its lower end strikes the end plate 26 to complete the magnetic circuit through the yoke 20, core 22 and end plate 26. Since the winding 19 on former 21 has become energized by closing of contacts 25 and 30 (in a manner which will be explained later) the core snaps against the plate 26 and is held in that position after release of rockable cover 3 and return of the arm 10 to the position shown in FIG. 1. The closing of the magnetic circuit ensures solid holding of the relay core even in the presence of strong vibration.

When the core is to be released, rocking of cover 3 and arm 10 in a counterclockwise direction causes the arm to engage the upper leg 35 on post 17. This action breaks contact between 25 and 30, removing current from the coil 19 on coil former 21, and allowing collapse of the flux in the yoke, core and end plate circuit (assisted by incidental air gaps between the yoke and the core at the upper end, and between the core and the end plate at the lower end) so that the core moves rapidly out of the former back to the position shown in FIG. 1.

It can be seen that this arrangement produces a snap action sensible by the operator both upon actuation of the device and closing of the relay when core 22 strikes plate 26, and also upon manual release of the relay by the hammering action of the shoulder 31 against the web 10". In order to balance the "feel" of the device generally, since the resilient resistance encountered by the arm 10 when moved in a clockwise direction to force core 22 into former 21 is somewhat more than that encountered when the arm 10 is rocked against leg 35 to open contacts 25 and 30, the anti-clockwise rotation resisting second spring 11 has been provided (as previously detailed). This results in essentially all of the manually applied rocking effort being applied to the shoulder 31 when switching the device "ON" but in the manually applied effort being resisted by the springs 11 (and leg 35) when the device is manually switched "OFF".

An indicator light 40, preferably a light emitting diode, is provided in the upper end of casing 1, directed to cause its light to fall on a window or lens 41 mounted in the rockable cover 3, to provide an indication to the operator whenever the device has been actuated and contacts 25 and 30 are in closed position.

Figure 4:
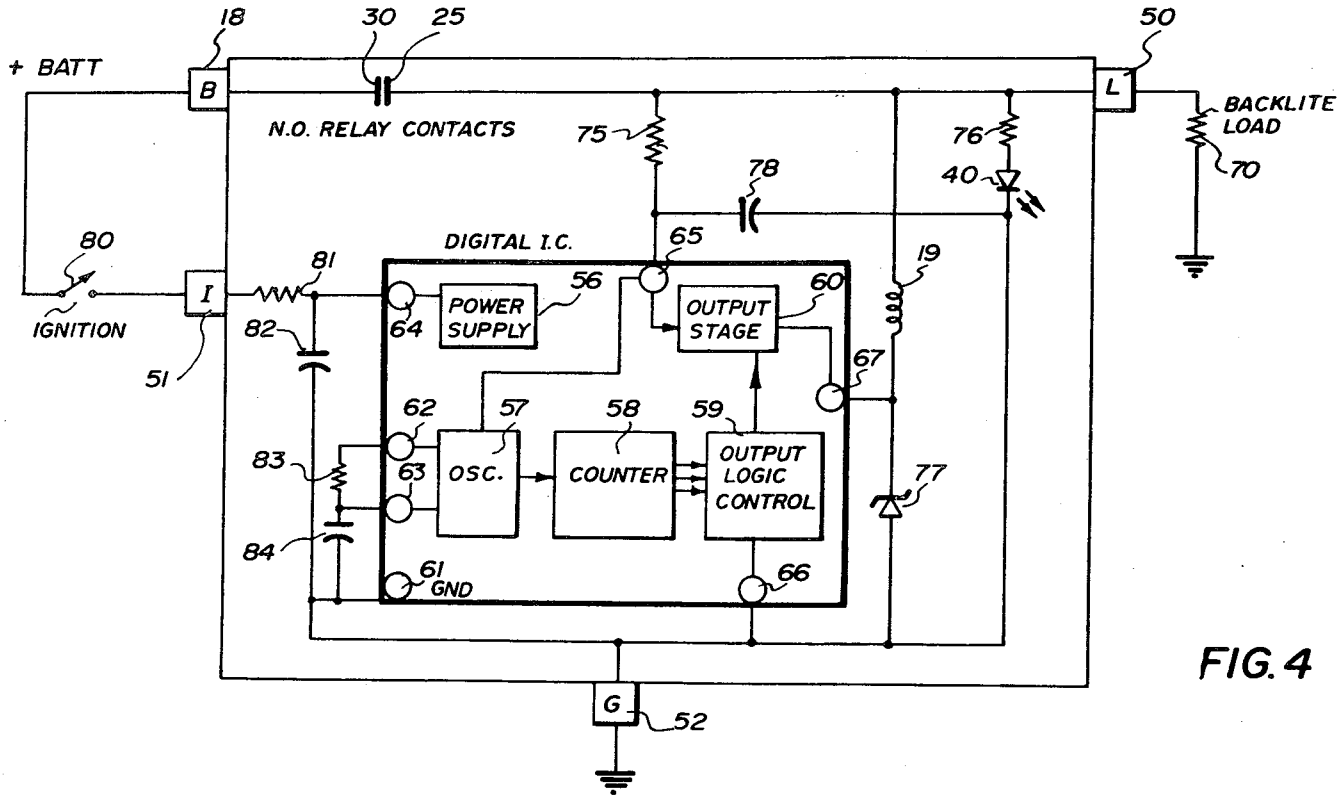
FIG. 4 is a schematic circuit diagram of electronic circuitry associated with the timing function of the device and employing a digital integrated circuit.

The schematic diagram of FIG. 4 illustrates the contacts 25 and 30, the light emitting diode 40, coil 19 for core 22, and the terminal 50 connected to the backlite load. Input terminal 53 provides input battery +ve to contact 30, and to ignition switch 80, which is in turn connected to input terminal 51. Battery −ve (not shown) is connected to ground which is applied to input terminal 52.

Referring in more detail to FIG. 4, there is included an integrated circuit packages 55 which embodies a power supply 56, an oscillator 57, a counter 58, an output logic control 59 and an output stage 60. Terminals provided on this package 55 are ground 61, oscillator input terminals 62 and 63, power supply input 64, initiating input 65, coil activate logic time select 66 terminal and output 67. Battery input at terminal 53 is applied to contact 30, and when the device is manually actuated to close contact 25 against contact 30, the battery is then applied to terminal 50 and the backlite load 70. Connected to the lead from contact 25 to terminal 50 are one side of resistor 75, one side of relay oil 19, a series connected resistor 76 and light emitting diode 40, whose other side is returned to ground. Thus the application of the battery potential to contact 25 also applies an initiating voltage to input 65, and also illuminates the diode 40. The voltage applied to relay coil 19 causes a current to flow through this coil via terminal 67 and thence to ground through output stage 60. This current provides sufficient magnetic flux in the relay yoke assembly, core and end plate to hold the core at its inner position, although the current is not sufficient itself to pull in the core in the absence of the manual actuation provided by the engagement of arm 10 on the shoulder 31. Because only a small current is needed for holding purposes the winding 19 is constructed with the characteristics of a holding coil, rather than the much heavier characteristics needed for a pull-in winding.

It can be seen that the closing of the car ignition switch 80 has also applied battery potential to terminal 51 which is fed through resistor 81 to power supply input 64. Protection against transients is provided by capacitor 78 between terminal 65 and ground, and by capacitor 82 between terminal 64 and ground. The application of the initiating voltage at 65 switches on the oscillator and the output stage 60. The oscillator is basically a relaxation circuit whose timing is effected by resistor 83 between terminals 62 and 63 and capacitor 84 between terminal 63 and ground. A typical frequency of oscillation is 3.4 hertz and this frequency is applied to the counter 58. Typically the counter would allow counting to 2,048 (which corresponds to a 10-minute period). The counter is read by the output logic 59, and when the total of 2,048 is achieved, the logic 59 triggers the output stage 60, which cuts off, interrupting the current through coil 19 and causing the core 22 to drop out. The zener diode 77 limits the voltage impulse appearing on terminal 67 due to the inductive effect of coil 19. The drop out of the core opens the contacts 30, 25 removing the power supply to the backlite load, to the light emitting diode 40, and to the input 65. The ignition switch 80 remains closed, however, so that the power supply 56 is still actuated, thereby retaining output logic 59 in a condition sensitive to the fact that it has produced an output following an initial count by counter 58.

If now the timer is actuated a second time by an operator again closing contacts 30,25 applying a new initiating input to terminal 65, the oscillator will once again be switched on and the counter 58 set in action. This time, however, as the output logic 59 reads the counter, it produces a signal to the output stage 60 after a count of only 1,024 is reached. This time corresponds to 5 minutes, and therefore the contacts 30, 25 are opened after a 5-minute period. As the output logic control 59 continues to be sensitive to the fact that an output has been produced, subsequent initiations of the device by closing contacts 30 and 25 will each time result in the 5-minute timing period. When ignition switch 80 is opened, the input to power supply terminal 64 is removed and the output logic 59 will also be deactivated. Any subsequent closing of ignition switch 80 will return the logic 59 to its initial state and will result in an initial timing output only after a count of 2,048 has been achieved.

The output logic 59 is provided with the time select terminal 66, which allows for different functions of the output logic control 59 dependent upon the voltage applied to terminal 66. If pin 66 is connected to ground 61 as illustrated in FIG. 4, then, as previously described, the first timing interval will allow for a count of 2,048 (10 minutes) whereas the subsequent counts will be 1,024 (5 minutes). If however pin 66 is connected to the positive voltage on pin 64, the initial count will, as before, be 2,048, but subsequent counts will be 512 (or 2.5 minutes). If terminal 66 is left unconnected, there is no change in response to the counter between the first and any subsequent timer actuations.

It can be seen therefore that considerable flexibility is provided for variations in timing period between an initial time out and subsequent timings, as may be desired. This kind of flexibility is not possible in an analog type of timer in which a capacitor is allowed to charge only once during the timing cycle. By using digital logic with a counter, much higher oscillation frequencies are permissible resulting in very, very much smaller capacitors with much higher tolerance and lower temperature sensitivity. Such changes result in a much smaller unit, lower cost, higher accuracy and improved flexibility and performance.

With the new device, testing is greatly facilitated because the oscillator runs at a constant speed and it can be checked for accurate frequency in a period of a few seconds. Using the electrolytic analog processes, matching of resistors to capacitors is necessary and testing requires the full run through of the timing period. Typically, using an analog device, the timing capacitor had to be of the order to 220 $\mu$fd with tolerances of $-50\%$ to $+100\%$. Using the much lower value charging capacitor 84 of the present disclosure (approximately 0.01 $\mu$fd) which is readily available at close tolerance, individual matching is no longer required.

By the particular structure shown, manual cancellation or override can be effected to switch the circuit off any time before its automatic time out since removal of potential from input 65, by manual opening of contacts 30, 25 will switch off the output stage 60. The removal of input at 65 also deactivates the oscillator 57, and subsequent reapplying and starting of the oscillator will cause the counter to start from zero. The count necessary for actuating output from logic 59 will depend upon whether or not the logic had already produced a first output, before the manual cancellation was effected.

Details of the counter 58 and the output logic control 59 and the way in which the output logic can read the counter 58 differently between an initial and subsequent operation will be apparent to those skilled in the art as well as the alteration of the reading dependent upon the application of ground, high voltage or open circuit to the terminal 66. $I^2L$ integrated circuit logic techniques are particularly suitable for the construction of the counter and output logic control.

I claim:

1. A timed switch for an electric load which comprises a housing, relay means mounted within said housing, said relay means including a pair of relay contacts for series connection with said load, movable relay core means connected to at least one of said contacts and relay holding means which when activated exert a holding force on said movable core means to hold said contacts in a closed condition and which when deactivated release said core means to release said contacts to an opened condition, a timer circuit mounted within said housing, manually actuable means carried by said housing for moving said contacts to the closed condition, said timer circuit being activated in response to the closing of said contacts by said manually actuable means, said relay holding means being activated in response to the closing of said contacts by said manually actuable means to exert the holding force on said core means and to hold said contacts in the closed condition, means interconnecting said timer circuit and said relay holding means for deactivating said relay holding means to release said core means and to release said contacts to the opened condition upon expiry of a predetermined time period measured by said timer circuit, said manually actuable means also including means for physically moving said contacts to the opened condition upon manual actuation thereof without having to overcome the holding force of said relay holding means on said core means.

2. A timed switch according to claim 1 including illuminatable indicating means within said housing connected for illumination upon closing of said contacts.

3. A timed switch according to claim 2 wherein said indicator means provides a visible illumination indication exterior of said housing adjacent said manually actuable means.

4. A timed switch according to claim 1 wherein said timer circuit includes means for measuring a first and a second said predetermined time period upon a first and a subsequent operation of said timer circuit, potential sensitive means in said circuit for modifying at least said second predetermined period, and means connecting said potential sensitive means for determined potential application thereto.

5. A timed switch according to claim 1 wherein said manually actuable means comprises means pivotally mounted on said housing which when pivoted in a first direction physically moves said contacts to the closed condition and which when pivoted in a second direction physically moves said contacts to the opened condition.

* * * * *